US009206537B2

(12) United States Patent
von der Fecht

(10) Patent No.: US 9,206,537 B2
(45) Date of Patent: Dec. 8, 2015

(54) FELTING DEVICE FOR FELTING FIBER MATERIALS

(76) Inventor: Jessica von der Fecht, Deutschland (DE)

( * ) Notice: Subject to any disclaimer, the term of this patent is extended or adjusted under 35 U.S.C. 154(b) by 375 days.

(21) Appl. No.: 13/577,903

(22) PCT Filed: Feb. 2, 2011

(86) PCT No.: PCT/EP2011/051490

§ 371 (c)(1),
(2), (4) Date: Oct. 29, 2012

(87) PCT Pub. No.: WO2011/098384

PCT Pub. Date: Aug. 18, 2011

(65) Prior Publication Data

US 2013/0045654 A1 Feb. 21, 2013

(30) Foreign Application Priority Data

Feb. 9, 2010 (DE) ..... 10 2010 007 225

(51) Int. Cl.
*D04H 17/00* (2006.01)
*D04H 18/02* (2012.01)

(52) U.S. Cl.
CPC ..... *D04H 17/00* (2013.01); *D04H 18/02* (2013.01); *Y10T 442/682* (2015.04)

(58) Field of Classification Search
CPC ..... D04H 17/00; D04H 18/02; D05C 15/06; D05B 97/02
USPC ..... 28/107, 108, 109, 110, 111, 113, 115; 112/80.03, 80.04, 80.06
See application file for complete search history.

(56) References Cited

U.S. PATENT DOCUMENTS

| | | | | | |
|---|---|---|---|---|---|
| 84,325 | A | * | 11/1868 | Waring | 28/107 |
| 1,917,162 | A | * | 7/1933 | Smith | 112/80.04 |
| 2,422,125 | A | * | 6/1947 | Parker | 112/80.04 |
| 2,533,420 | A | * | 12/1950 | Blumfield | 112/80.04 |
| 2,581,894 | A | * | 1/1952 | Wilson | 112/80.05 |
| 2,837,045 | A | * | 6/1958 | Gifford | 112/80.04 |
| 2,879,731 | A | * | 3/1959 | Ward et al. | 112/80.04 |
| 2,887,076 | A | * | 5/1959 | Sterner | 112/80.04 |
| 3,229,653 | A | * | 1/1966 | Roberts et al. | 112/80.04 |
| 3,968,758 | A | * | 7/1976 | Scholz | 112/80.04 |
| 4,007,698 | A | * | 2/1977 | Thaheld et al. | 112/80.04 |
| 4,110,875 | A | * | 9/1978 | Foster | 28/115 |

(Continued)

FOREIGN PATENT DOCUMENTS

| | | |
|---|---|---|
| DE | 240 038 | 10/1986 |
| DE | 41 22 991 | 1/1993 |

(Continued)

OTHER PUBLICATIONS

English language machine translation of DE 4122991 A1. Pub. Jan. 1993. translation 5 pages.*

*Primary Examiner* — Amy Vanatta
(74) *Attorney, Agent, or Firm* — Seed IP Law Group PLLC

(57) ABSTRACT

The present invention concerns a felting device for felting fiber materials including a needle receiving means for receiving and holding a felting needle for performing the felting operation, a drive motor for moving the needle receiving means for moving the inserted felting needle and a housing for movably holding and guiding the felting device with a hand.

14 Claims, 4 Drawing Sheets

(56) References Cited

U.S. PATENT DOCUMENTS

| | | | | | |
|---|---|---|---|---|---|
| 4,132,182 | A | * | 1/1979 | Heemstra | 112/80.04 |
| 4,267,784 | A | | 5/1981 | Heemstra | |
| 4,475,473 | A | * | 10/1984 | Samoilov et al. | 112/80.04 |
| 5,003,674 | A | * | 4/1991 | Cohen et al. | 28/109 |
| 5,090,341 | A | * | 2/1992 | Satterfield | 112/80.4 |
| 5,226,217 | A | * | 7/1993 | Olry et al. | 28/107 |
| 2008/0189911 | A1 | | 8/2008 | Loxam-Kohl | |
| 2009/0101052 | A1 | * | 4/2009 | Tamura | 112/104 |

FOREIGN PATENT DOCUMENTS

| | | | | | |
|---|---|---|---|---|---|
| DE | 112006000881 | | | 4/2006 | |
| GB | 618165 | A | * | 2/1949 | |
| GB | 665495 | | * | 1/1952 | |
| GB | 1558872 | A | * | 1/1980 | |
| GB | 2126612 | A | * | 3/1984 | D04H 1/20 |
| GB | 2129453 | | | 5/1984 | |
| JP | 2009150019 | | | 7/2009 | |
| WO | WO2006/108301 | | | 10/2006 | |

* cited by examiner

FELTING DEVICE FOR FELTING FIBER MATERIALS

BACKGROUND

1. Technical Field

The present invention concerns a felting device for felting fiber materials and methods of felting and an article produced by felting.

2. Description of the Related Art

Felting of fiber materials, in particular wool materials, has long been known and a distinction is basically drawn between two felting technologies, dry felting and wet felting. In both technologies, basically the raw wool sheared from the sheep, washed, dried and combed is processed in such a way that the result produced is in particular a closed, fixedly joined felt layer or felt form.

The term fiber materials is basically used hereinafter to denote all materials consisting of fibers, in particular this includes both raw material and also processed material. In the case of processed material this can basically be of any form. Fiber materials in the present case include in particular wool such as sheep's wool, yak wool, alpaca wool and also angora to give just some examples. In addition fiber materials also include vegetable materials such as cotton or hemp fibers. Fiber materials can also involve artificial, industrially manufactured materials.

The present invention concerns dry felting. In dry felting for example a felting needle which is about 8 cm in length and which is ground into a triangular configuration and which has barbs at the tip is repeatedly pushed into the raw wool. Barbs at the tip of the needle cause the individual fibers of the raw wool to be hooked together in each movement. That procedure has to be repeated until a firm closed layer has been formed at least in the desired region and the fibers are felted together. In that way for example it is also possible for two felt layers to be joined together, more specifically felted together, if the felting needle is repeatedly pushed through both layers which bear against each other and the fibers of the two layers hook into each other so that the layers are joined together.

Thus basically so much wool in a plurality of layers can be applied to each other or to an existing article and processed until the result is a desired form. In that way for example a ball, a felt animal, a hat or a slipper can be produced or improved. Basically it is possible in that way to produce virtually any desired form.

A disadvantage in that respect is that this kind of manual felting in the long term is very strenuous and tiring. To accordingly achieve an improvement, felting by means of a machine has already been proposed. Such a machine is essentially similar to a sewing machine, without a bobbin thread. Basically, instead of a sewing needle, a felting needle is moved with an oscillating motion and for the felting operation the corresponding layers to be felted are moved along between the oscillating felting needle and a backing plate. Felting with such a machine is much faster in contrast to manual felting.

Such felting machines include a needle region for movement of the needle, a backing plate or plate and a side arm connecting the two and are thus of considerable size and weight and are correspondingly difficult to move and are therefore arranged stationarily in use. A further disadvantage is that only objects up to a certain size can be processed with such machines as the objects have to be passed through in the limited space between the needle, the plate and the side arm.

Another disadvantage with such machines is that it is practically not possible to felt hollow objects in which for example something is to be applied by felting to an outer layer or wall of the hollow object. In the case of a slipper for example there is the risk that, when attempting to felt something on to its top side, it could be felted to the lower side, which is not wanted.

BRIEF SUMMARY

Therefore one object of the present invention is to reduce one of the above-described problems. Another embodiment provides a solution for facilitating manual felting that avoids the disadvantages of previously known felting devices. The invention seeks to propose an alternative.

According to the invention therefore there is proposed a felting device for felting fiber materials as set forth in claim 1.

Such a felting device thus includes a needle receiving means for receiving and holding a felting needle for performing the felting operation. Thus for example a known felting needle can be received and held fast with its rear side in the needle receiving means. Preferably such felting needles are interchangeable. It is however also conceivable that a felting needle is fixedly connected to the needle receiving means of the felting device without provision for exchanging an individual felting needle.

The felting device further includes a drive motor for moving the needle receiving means in order thereby ultimately to move the inserted felting needle. In particular the arrangement involves an oscillating movement of the needle receiving means with inserted felting needle in the longitudinal direction of the felting needle. The drive motor is preferably in the form of an electric motor. Basically however other motors can be considered, such as for example a drive by a spring storage means with a spring which can be tightened up, such as for example a spiral spring which can be wound up similarly to a mechanical clock.

Finally there is proposed a housing for movably holding and guiding the felting device with a hand. In that way it is possible for the felting device to be guided with a hand along the object to be felted at the desired location or the desired region and for the felting operation to be performed by the oscillating felting needle. Basically the size and shape of the object to be felted are not important. The felting device according to the invention can also be referred to as a hand felting device or portable hand felting device. It is preferably twice as fast as a commercially available felting device as described hereinbefore. In comparison therewith the hand felting device according to the invention is particularly small, manageable, light and mobile. Its manageable light construction also makes it possible to achieve an energy-saving structure.

With the felting device according to the invention it should now be possible basically to felt any large, small, three-dimensional and hollow objects. The structure involved makes it possible for a large radius of action to exist at all sides as the hand felting device is appropriately held with its housing in a hand and the operator can thus felt around the object in question. The object to be felted does not now have to be moved as in the case of the above-described machines. Particularly in the case of very large, heavy, unmanageable and also in the case of very small objects, that can be a very major advantage. Because of the size and the low weight of the hand felting device which is to be guided by hand, it can basically be used everywhere. If the hand felting device itself does not have an energy storage means for operating the drive motor the need for an electric connection still at most limits the range of use. When employing an electric motor with accumulator or battery in the hand felting device even that limitation disappears and the hand felting device according to the invention can also be readily used for example in the open air. Finally felting of hollow articles can be made easier because the user, with the felting device in the hand, can more accurately determine and control the depth of penetration of the needle. The risk of the needle penetrating through a hollow space into an opposite side and thus causing felting through the hollow space which is undesirable, can thus be eliminated or at least however reduced.

The housing can preferably accommodate all components of the felting device so that essentially there is only still the felting needle that partially projects out of the housing. Completely accommodating the components of the felting device however is not a necessary prerequisite for the housing. Rather the felting device is to be guided with a hand by means of the housing and in that respect, instead of the housing or in addition thereto, there can be provided a holding means for movably holding and guiding the felting device with a hand.

In an embodiment the felting device is characterized by a guide means for axially guiding the felting needle and/or the needle receiving means. That can provide for axial movement of the felting needle and thus accurate felting. The guide means can be for example a guide shank, in particular a cylindrical guide shank, in which the felting needles and/or the needle receiving means slides in the axial direction. Preferably the needle receiving means is guided so that the guide means can be substantially independent of the size and configuration of the felting needle and also no problems of slidingly guiding the barbs of a felting needle arise. In such a case the felting needle can be simply replaced by a new one and/or by another one as required without this having to have an influence on guidance.

A further embodiment proposes a felting device characterized in that there is provided a joint connection, in particular a cardan joint, for coupling the needle receiving means to the drive motor, in order to convert a non-axial movement, caused by a rotary movement of the drive motor, into an axial oscillating movement of the felting needle. A rotary movement of the drive motor can basically be converted similarly to a crankshaft and connecting rod into a substantially translatory, that is to say axial, movement. By virtue of a further connection by way of a cardan joint in relation to the needle receiving means, it is possible for the needle receiving means or the felting needle to provide a basically completely axial movement, the rectilinearity of which ultimately depends on the guide means. Such conversion can easily be achieved by the cardan shaft. In principle a joint connection with a simple joint can be sufficient. The use of a cardan joint provides greater tolerance in relation to lack of synchronicity and uniformity of motion in the upstream-connected drive train and can compensate for tolerances. In addition it is possible to provide a simple and compact structure whereby guiding the felting device with a hand in accordance with the invention is facilitated.

In that way it is possible to produce an axial or linear movement by means of a commercially usual rotating motor, in particular an electric motor. In another embodiment it is also possible to provide a linear motor which directly produces the desired linear oscillating motion. That can be achieved for example by means of two electric coils which produce the oscillating movement by alternate current feed thereto.

As a further embodiment there is proposed a pushbutton switch for switching the drive motor on and off and/or starting and stopping a needle movement of the felting needle. Thus the felting needle is moved when the pushbutton switch is pressed and stops moving as soon as the pushbutton switch is no longer pressed. The pushbutton switch thus permits easy handling and is preferably so arranged that it can be actuated at the same time with the same hand as that with which the felting device is also held and moved. Preferably the pushbutton switch is arranged directly on the housing. In that way the felting device can be easily operated with one hand and can be switched on and off almost as desired. In particular frequently stopping the device in one region and starting it up again in another region is simplified.

Thus the movement of the felting needle is to be controlled by the pushbutton switch. That can be effected by starting or stopping the motor or also by an intervention at another location, such as for example by interrupting the drive train between the motor and the felting needle.

In a further preferred embodiment there is proposed a felting device which is characterized in that the drive motor is in the form of an electric motor, in particular a dc motor, and/or is supplied with electric current by way of an energy storage means accommodated in the housing, in particular a battery or accumulator.

The use of an electric motor affords a simple possible form of implementation of a hand felting device. The power supply to the electric motor can be connected or interrupted by a switch such as a button switch in order thereby to start or stop the motor and thus the movement of the felting needle. The use of an energy storage means such as a battery or accumulator means that the felting device is independent of an external power supply and troublesome cables can be eliminated. A dc motor can be simply coupled to a battery or accumulator as they also supply a dc voltage or a direct current.

Preferably the guide means for axially guiding the felting needle or the needle receiving means opens with a front end into a housing opening or such an end forms a housing opening. In that respect, in that case the structure should be such that the felting needle when used as intended for the felting operation is pushed out of that opening and pulled into it again in an oscillating motion. In that respect the felting needle can be pulled in each case so completely into the opening that in the pulled-in condition it no longer projects from the opening. In that case the felting device can be guided with that housing opening along the region to be felted of the object to be felted. In particular that easily permits uniform felting.

It is desirable if the felting device is characterized in that the length by which the felting needle projects at a maximum out of the or a housing opening during a movement for the felting operation is adjustable. That makes it possible to adjust the depth of penetration of the felting needle into the object to be felted. That depth of penetration corresponds to the length by which the felting needle projects at a maximum out of the housing opening when the housing opening is guided directly along the surface of the object to be felted. Depending on the respectively required depth of penetration the projection length can then be adjusted. For example, when felting two felt layers which are placed one upon the other, the overall thickness thereof can be adjusted as the length by which the felting needle projects at a maximum out of the housing opening. In addition such adjustability also makes it possible to adapt the felting device to felting needles of differing lengths.

Adjustability can be achieved for example by a telescopic opening or also by a change in the position of the needle receiving means within the felting device, by for example the spacing between the needle receiving means and the connection to the motor being shortened or lengthened. The spacing between the or a joint connection like a cardan joint to the needle receiving means can also be adapted to be adjustable for that purpose.

The depth of penetration can also be influenced by a change in a stroke travel of the needle receiving means and therewith the felting needle. The stroke length which can also be described as the oscillation amplitude can also influence the length of movement within the material to be felted.

Preferably the or a guide means for axially guiding the felting needle or the needle receiving means is in the form of a sleeve. The felting needle and/or needle receiving means can thus be guided in the axial direction in the sleeve. Adjustability of the length by which the felting needle projects at a maximum out of a housing opening can also be achieved by pulling the sleeve out or pushing it in, if an end of the sleeve terminates with the housing opening.

A felted article which was produced by means of a felting device according to the invention can be recognized—depending on the respective embodiment of the felting device—by the uniformity of felted regions, in particular a uniform depth of penetration of a felting needle and the resulting felting depth.

BRIEF DESCRIPTION OF THE SEVERAL VIEWS OF THE DRAWINGS

The invention is described by way of example hereinafter by means of an embodiment with reference to the accompanying Figures in which.

DETAILED DESCRIPTION

Figure 1:
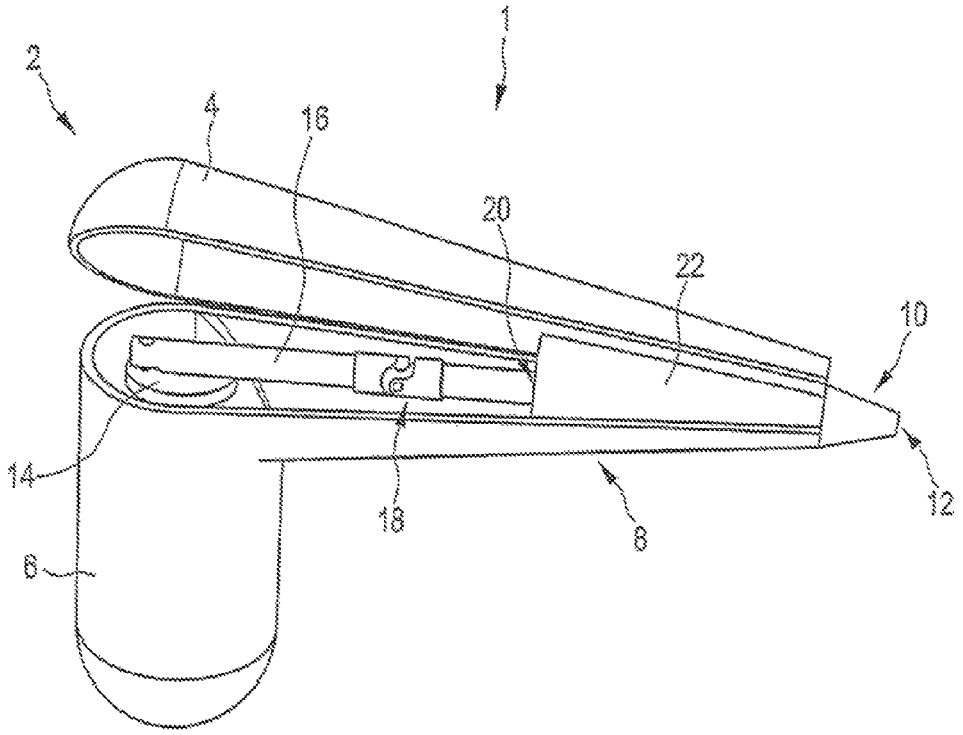
FIG. 1 shows a perspective view of a felting device according to the invention with an opened housing cover.

The felting device 1 in FIG. 1 has a housing 2 with opened housing cover 4. The housing 2 has a motor portion 6 for accommodating a motor and a guide portion 8 having a housing tip 10 and a housing opening 12.

Accommodated in the motor portion 6 is a motor which drives a rotary disk or a disk 14 which transmits a rotary movement to a connecting rod 16 which in turn transmits the movement by way of a cardan joint 18 to a needle receiving means 20. The needle receiving means 20 is guided together with an inserted felting needle in a guide cone 22. For that purpose the guide cone 22 has an internal bore in the axial direction of the needle receiving means and thus in the axial direction of an inserted felting needle, in which the needle receiving means 20 is guided slidingly in the axial direction. The guide cone thus operates as a guide means.

FIG. 1 shows the felting device 1 in a condition in which the needle receiving means 20 and thus a felting needle is in a maximum retracted position. Therefore in the view in FIG. 1 a felting needle does not project out of the housing 2 and in particular not out of the housing tip 10.

By initiating a rotary movement of the rotary disk 14 however the connecting rod 16, the cardan joint 18 and the needle receiving means 20 are moved together with an inserted felting needle in a direction towards the housing opening 12 whereby the felting needle is pushed out of the housing opening 12—thus towards the right in FIG. 1.

Figure 2:
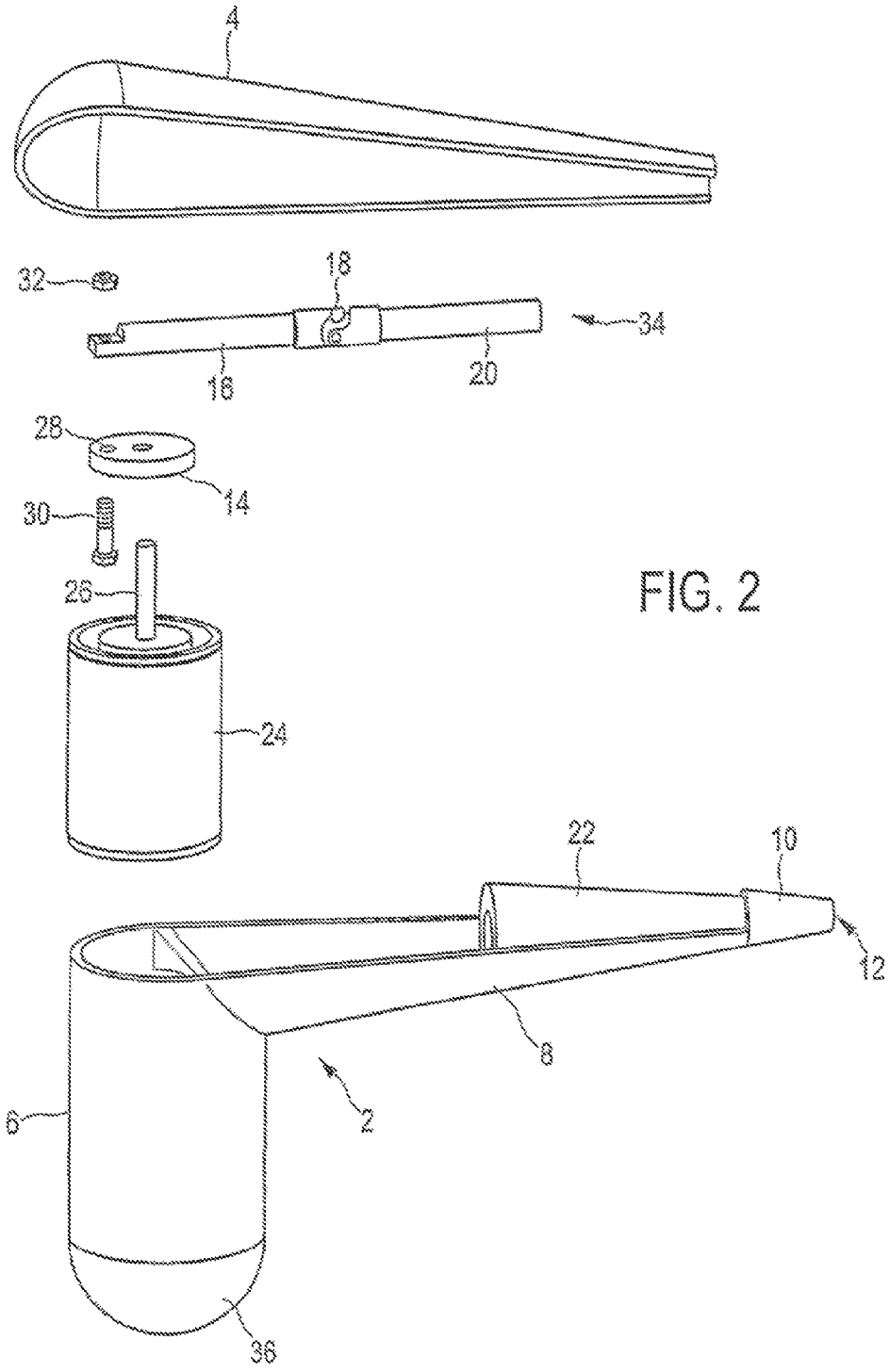
FIG. 2 shows an exploded perspective view of the felting device according to the invention as shown in FIG. 1.

FIG. 2 is an exploded view showing further details of the felting device. Accordingly there is provided an electric motor 24 accommodated in the motor portion 6 of the housing 2. The electric motor 24 has a motor shaft 26 which is torsionally rigidly connected to the rotary disk 14. The rotary disk 14 has an eccentric opening 28 to which the connecting rod 16 is rotationally fixed by means of a screw 30 and a nut 32.

The connecting rod 16 is connected to the needle receiving means 20 by means of a cardan joint 18. The needle receiving means 20 has a receiving opening 34 into which a felting needle can be inserted and connected to the needle receiving means 20.

To insert or exchange a felting needle the housing cover 4 can be opened and, after release of the nut 32, the needle receiving means 20 together with the cardan joint 18 and the connecting rod 16 can be removed from the housing 2 to insert a felting needle. In other embodiments the felting needle can be inserted directly through the housing opening 12 into the needle receiving means 20 and fixed for example by means of a bayonet connection, possibly the tip 10 would have to be removed for that purpose.

In the illustrated embodiment the electric motor 24 is arranged substantially with its longitudinal axis in transverse relationship to the longitudinal axis of the needle receiving means 20. That is a particularly efficient structure which in addition makes it possible to implement a housing 2 which as illustrated is of an approximately angular configuration. Such a housing and therewith the felting device overall can be well managed with a hand and this also makes it possible for the housing to be held in different ways.

The felting device shown by way of example is substantially of a length of 16.3 cm, a width of 11 cm, which substantially corresponds to the length of the motor portion 16, and a depth of 4.3 cm. In this case the entire felting device weighs only about 250 g. The drive used is a 12 V motor which is powered by way of a power pack which is not subject-matter of this embodiment and is also not shown in the Figures. The power consumption of the drive is at a maximum loading 7 W at 0.7 A. The motor has a nominal rotary speed of 2500 rpm.

The housing comprises glass fiber-reinforced plastic impregnated with epoxy resin.

The handle of the housing is of a cylindrical shape and ends in a hemisphere and accommodates the motor. The hemisphere identified by reference 36 has an opening with a bush outwardly for the power connection for powering the motor. That power connection bush, not shown in the Figure, is connected in the interior of the housing by way of a power cable both to the motor and also to an on/off switch. The on/off switch which is in the form of a pushbutton switch is mounted externally on the housing. Such a pushbutton switch is shown in a side view in FIG. 3. The motor can be started and stopped by that switch.

The screw 30 on the rotary disk 14 serves at the same time as a pin to which the connecting rod 16 is connected. In this interaction the needle receiving means 20 serves at the same time as a pushrod and thus the rotary movement of the motor is converted into a linear stroke movement. The stroke travel or an oscillation amplitude can be varied by a variation in the radius of the rotary disk 14 or by a variation in the spacing of the screw 30 relative to the center point of the rotary disk 14—the effective radius of the rotary disk.

To accommodate a commercially usual felting needle the needle receiving means 20 has a groove which is milled in centrally in respect of length, as will be described hereinafter. The guide portion 8 of the housing 2 is of a configuration that converges conically towards the opening 12 and in its interior directly in front of the opening 12 has a guide casing which is bonded in position there and in which the pushrod or the needle receiving means 20 together with the felting needle moves to and fro.

Figure 3:
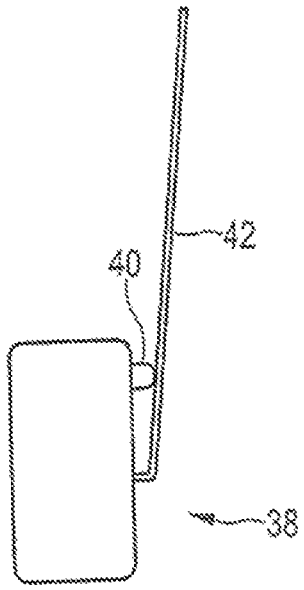
FIG. 3 shows a side view of a pushbutton switch.

A switch 38 shown in FIG. 3 is in the form of a pushbutton switch. The switch 38 has a switching knob 40 which closes a circuit by being pushed into the switch and which opens it again when it is released. To simplify pressing and releasing the switching mechanism there is provided a switching lever 42 which is fixed to the switch 38 and by way of which the switching knob 40 is pressed. The switch 38 is so arranged on the housing 2 of the felting device that the switching lever 42 is arranged substantially flat in relation to the housing 2 and can thus be easily actuated by the operator. Namely, the lever 42 can form one wall of the housing 2, so that pressing on a selected location of the housing, the switch 40 is pressed to turn the motor either on or off, as a toggle switch. Alternatively, the lever 42 can be adjacent to the housing 2.

Figure 4:
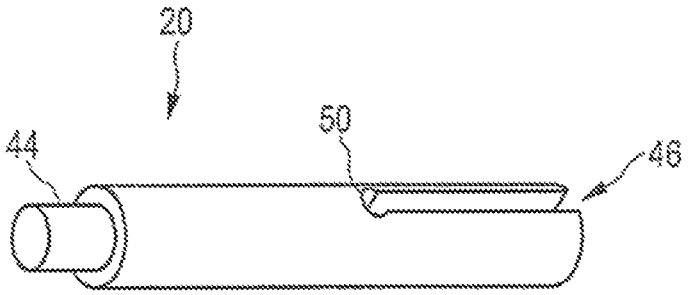
FIG. 4 shows a perspective view of a needle receiving means.

The needle receiving means 20 is shown as an individual element in FIG. 4 and is shown on an enlarged scale as a perspective view. It has a connecting portion 44 for connection to the cardan joint 18. A groove 46 is milled centrally in the needle receiving means 20 in opposite relationship to the cardan joint 18 to hold a felting needle therein.

Figure 5:
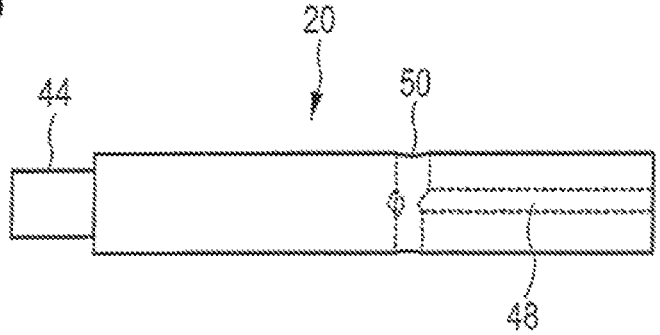
FIG. 5 shows a sectional side view of the needle receiving means 20 in FIG. 4.

In addition there is also a longitudinally axial bore (not shown in the Figure) which is concentric relative to the needle receiving means, for holding the felting needle. That longitudinal bore is of a diameter slightly larger than the thickness of the groove 46. That affords a kind of channel at each side of the groove 46, as can be seen from the sectional side view in FIG. 5. The axial bore is denoted there by reference 48.

Finally the needle receiving means 20 also has a transverse bore 50. That can be used for fixing a felting needle, in particular a commercially usual felting needle, which at its rear end has an angled portion which in use as intended is accommodated in the transverse bore 50.

Figure 6:
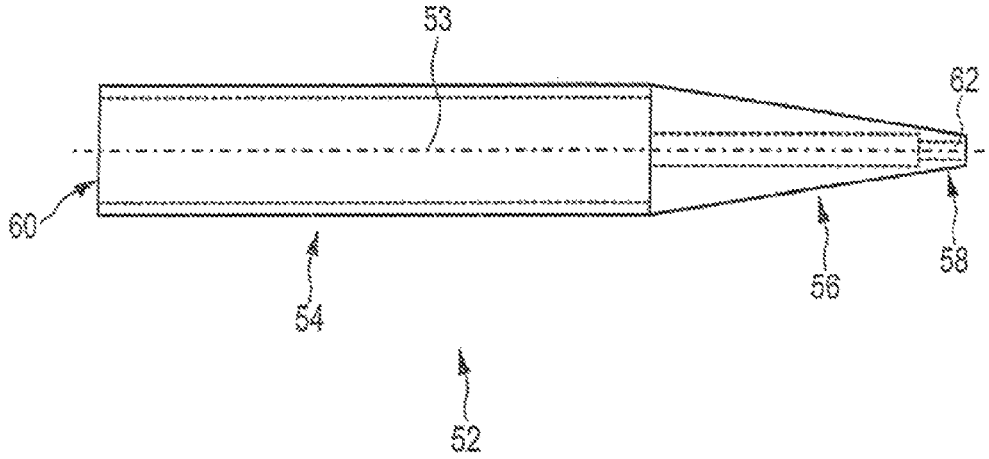
FIG. 6 shows a sectional side view of a guide sleeve.

FIG. 6 shows a sectional side view illustrating a guide sleeve 52 arranged in the guide cone 22 for guiding the needle receiving means 20. The guide sleeve is concentric relative to a center line 53 and has a cylindrical guide portion 54, a central portion 56 and a tip portion 58. Provided in the cylindrical guide portion 54 is a longitudinally axial bore which is of an inside diameter adapted to the outside diameter of the needle receiving means 20 to be guided. By way of example the outside diameter of the needle receiving means 20 in the relevant region is 6 mm and the inside diameter of the guide portion 54 is 6.5 mm. The needle receiving means 20 can thus be guided slidingly in the axial direction in the bore 60.

The central portion 56 and the tip portion 58 are arranged together in a conical tip region and also each have a concentric bore which is at least slightly larger in diameter than a felting needle to be accommodated. In this case the end portion 58 has a support bore 62 which is of an only slightly larger inside diameter than the diameter of a felting needle to be used. It is possible in that way for the felting needle to be supported in the support bore 62 in the case of any transverse forces which occur.

The various embodiments described above can be combined to provide further embodiments. All of the U.S. patents, U.S. patent application publications, U.S. patent application, foreign patents, foreign patent application and non-patent publications referred to in this specification and/or listed in the Application Data Sheet are incorporated herein by reference, in their entirety. Aspects of the embodiments can be modified, if necessary to employ concepts of the various patents, application and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A hand held felting device for felting fiber materials, the hand held felting device including:

a single felting needle;

a needle receiving means holding the felting needle for performing a felting operation, the needle receiving means including a guide sleeve that includes a first portion having a first bore of a first diameter, a second portion having a second bore of a second diameter that is less than the first diameter, and a third portion having a third bore of a third diameter that is less than the second diameter, wherein the first, second, and third bores are concentric with each other, wherein the felting needle is configured to move axially within the first, second, and third bores, an electric motor for moving the needle receiving means for moving the held felting needle, and a housing means enclosing the needle receiving means, the housing means for movably holding, operating, and guiding the entire hand held felting device with a user's hand.

2. The felting device as set forth in claim 1 further comprising a guide cone for receiving a portion of the guide sleeve.

3. The felting device as set forth in claim 1 further comprising a joint connection for coupling the needle receiving means to the electric motor, in order to convert a non-axial movement, caused by a rotary movement of the electric motor, into an axial oscillating movement of the held felting needle.

4. The felting device as set forth in claim 1 further including a pushbutton switch located on the housing means that is configured to engage and disengage the electric motor for starting and stopping a needle movement of the held felting needle.

5. The felting device as set forth in claim 1 further including an energy storage means positioned in the housing means for providing electric current to the electric motor.

6. The felting device as set forth in claim 1 wherein the guide sleeve axially guides the felting needle, wherein the third bore of the third portion of the guide sleeve is concentric with an opening of the housing means, and the felting needle, when in use as intended for the felting operation, is pushed out of said opening and pulled into said opening in an oscillating movement.

7. The felting device as set forth in claim 1 wherein the felting needle projects from the housing means and a length that the felting needle projects from the housing means is adjustable.

8. A method of joining two fiber articles by felting to provide an article joined by felting, the method including:

placing the two fiber articles to be joined against each other, and felting the two fiber articles that are applied against each other in the respective desired region, wherein a felting device as set forth in claim 1 is used for performing the felting step.

9. A hand held felting device for felting fiber materials, the hand held felting device including:

a single felting needle;

a guide sleeve for guiding the felting needle that performs a felting operation, the guide sleeve including a first portion having a first bore of a first diameter, a second portion having a second bore of a second diameter that is less than the first diameter, and a third portion having a third bore of a third diameter that is less than the second diameter, wherein the first, second, and third bores are concentric with each other, wherein the felting needle is configured to move axially within the first, second, and third bores;

a guide cone that holds a portion of the guide sleeve;

an electric motor coupled to the felting needle for moving the felting needle; and a housing that encloses the guide sleeve, the guide cone, and the electric motor, the housing being portable and for permitting holding and guiding the entire hand held felting device with a hand.

10. The felting device as set forth in claim 9 wherein there is provided a cardan joint for coupling the needle member to the electric motor, in order to convert a non-axial movement, caused by a rotary movement of the electric motor, into an axial oscillating movement of the felting needle.

11. The felting device as set forth in claim 9 further including a pushbutton switch for starting and stopping a needle movement of the felting needle.

12. The felting device as set forth in claim 9 further including:

an electric battery positioned in the housing for providing electric current to the electric motor.

13. The felting device as set forth in claim 9 wherein the housing has an opening that exposes the third bore of the third portion of the guide sleeve, and the felting needle, when in use as intended for the felting operation, is pushed out of said opening and pulled into said opening in an oscillating movement.

14. The felting device as set forth in claim 13 wherein the length by which the felting needle projects at a maximum out of the housing during a movement for the felting operation is adjustable.

* * * * *